US007942096B2

(12) United States Patent
Blaser et al.

(10) Patent No.: US 7,942,096 B2
(45) Date of Patent: May 17, 2011

(54) METHOD OF CONTROLLING A POWDER SPRAYER AND PRINTING PRESS HAVING A POWDER SPRAYER

(75) Inventors: Peter Theobald Blaser, Dielheim (DE); Claudius Haas, Nussloch (DE); Marius Stelter, Heidelberg (DE)

(73) Assignee: Heidelberger Druckmaschinen, Heidelberg (DE)

( * ) Notice: Subject to any disclaimer, the term of this patent is extended or adjusted under 35 U.S.C. 154(b) by 755 days.

(21) Appl. No.: 11/874,968

(22) Filed: Oct. 19, 2007

(65) Prior Publication Data

US 2008/0092762 A1 Apr. 24, 2008

(30) Foreign Application Priority Data

Oct. 20, 2006 (DE) ..... 10 2006 049 648

(51) Int. Cl.
*B41F 23/06* (2006.01)

(52) U.S. Cl. ..... 101/420; 101/424.2

(58) Field of Classification Search ..... 101/416.1–422, 101/424.2; *B41F 23/06, 22/00; B41M 7/02*
See application file for complete search history.

(56) References Cited

U.S. PATENT DOCUMENTS

| | | | | |
|---|---|---|---|---|
| 4,332,198 | A * | 6/1982 | Schmoeger | 101/424.2 |
| 5,540,152 | A * | 7/1996 | DeMoore | 101/483 |
| 5,931,095 | A * | 8/1999 | Platsch | 101/424.2 |
| 6,267,540 | B1 * | 7/2001 | Haas | 406/153 |
| 6,401,611 | B1 * | 6/2002 | Gunschera | 101/232 |
| 6,413,580 | B1 | 7/2002 | Haas et al. | |
| 6,598,874 | B2 * | 7/2003 | Hachmann et al. | 271/276 |
| 6,612,235 | B2 * | 9/2003 | Frankenberger et al. | 101/231 |
| 2004/0069220 | A1 * | 4/2004 | Platsch | 118/300 |
| 2006/0107857 | A1 | 5/2006 | Haas et al. | |

FOREIGN PATENT DOCUMENTS

| | | | |
|---|---|---|---|
| DE | 4237111 | B4 | 5/1994 |
| DE | 19751383 | A1 | 5/1999 |
| DE | 19937090 | A1 | 2/2000 |
| DE | 10001590 | A1 | 8/2001 |
| DE | 10325386 | A1 | 12/2004 |
| DE | 102004057478 | A1 | 6/2006 |
| EP | 1116583 | A2 | 7/2001 |
| WO | 2004106066 | A1 | 12/2004 |

OTHER PUBLICATIONS

German Search Report dated Mar. 8, 2007.

* cited by examiner

*Primary Examiner* — Judy Nguyen
*Assistant Examiner* — Jennifer Simmons
(74) *Attorney, Agent, or Firm* — Laurence A. Greenberg; Werner H. Stemer; Ralph E. Locher

(57) ABSTRACT

A method of controlling a powder sprayer having a fan jet nozzle configuration in a printing press, includes controlling the fan jet nozzle configuration as a function of operating parameters of the printing press. A printing press having a powder sprayer is also provided.

8 Claims, 2 Drawing Sheets

METHOD OF CONTROLLING A POWDER SPRAYER AND PRINTING PRESS HAVING A POWDER SPRAYER

CROSS-REFERENCE TO RELATED APPLICATION

This application claims the priority, under 35 U.S.C. §119, of German Patent Application DE 10 2006 049 648.5, filed Oct. 20, 2006; the prior application is herewith incorporated by reference in its entirety.

BACKGROUND OF THE INVENTION

Field of the Invention

The present invention relates to a method of controlling a powder sprayer having a fan jet nozzle configuration in a printing press. The invention also relates to a printing press having a powder sprayer.

German Published, Non-Prosecuted Patent Application DE 100 01 590 A1 describes a powder sprayer with a fan jet nozzle configuration. That powder sprayer includes nozzle heads disposed in a row. Each nozzle head includes two nozzles, each of which emits a powdered-air jet. A blower tube emitting compressed-air jets is disposed above the nozzle heads. The emission speed of those compressed-air jets is approximately twice as high as the speed of the powdered-air jets. Together, the compressed-air jets form a supportive fan jet that is free of powder and surrounds the powdered-air jets on all sides. The supportive fan jet screens the powdered-air jets off against turbulent flows that are caused by the movement of a gripper conveying the printed sheet. That ensures that the powdered-air jets reach the printed sheet, unaffected by the turbulent flows. However, if printed sheets made of paper are processed, the print quality may suffer as compared to printed sheets made of board. Although the momentum exerted by the supportive fan jet on the printed sheets is suitable for board sheets, it is too strong for paper sheets. The momentum affects the transportation of the paper sheets, which consequently begin to flutter. Problems arise, in particular, when both sides of the paper sheets have just been printed. In many printing presses, a sheet-guiding device is disposed opposite the powder sprayer, which means that the freshly printed upper side of the sheets faces the powder sprayer and the lower side of the sheets, which has also been recently printed, faces the sheet-guiding device. Due to the fluttering, the paper sheets may hit the sheet-guiding device, causing the printed image on the lower side of the sheets to become smeared. That means a considerable loss of print quality.

German Published, Non-Prosecuted Patent Application DE 199 37 090 A1, corresponding to Patent Abstracts of Japan Publication No. 2001070842 A, describes a method of powdering printed sheets wherein a powdered-air jet is generated by a blown-air generator. During operation, the output of the blown-air generator is varied to adapt the output of the blown-air generator, inter alia, to the conveying speed of the printed sheets or to the machine speed. The pressure of the powdered-air jet is adjustable between 0.1 bar and 0.5 bar (i.e. approximately between 1.5 psi and 7.3 psi).

German Patent DE 42 37 111 B4 describes a powder sprayer that is controlled by a programmed control unit. The control unit includes a keyboard for inputting basic parameters for an upcoming print job. Those basic parameters include, for example, the format of the sheets to be printed and the conveying speed.

SUMMARY OF THE INVENTION

It is accordingly an object of the invention to provide a method of controlling a powder sprayer and a printing press having a powder sprayer, which overcome the hereinafore-mentioned disadvantages of the heretofore-known methods and devices of this general type and in which a fan jet nozzle configuration ensures that a high level of print quality is maintained at all times.

With the foregoing and other objects in view there is provided, in accordance with the invention, a method of controlling a powder sprayer having a fan jet nozzle configuration, which may also be referred to as a surrounding jet nozzle configuration, in a printing press. The method comprises controlling the fan jet nozzle configuration as a function of operating parameters of the printing press.

As a result of this feature, the air supply to the fan jet nozzle configuration can be varied from print job to print job in order to adapt the air supply during operation to the requirements of the respective print job in an optimum way and to avoid adverse effects on the transportation of the sheets due to the powder sprayer. Thus, for every print job, the print quality remains on the same high level.

In accordance with another mode of the invention, the operating parameters are different printed sheet grammages, i.e. different specific masses per unit of area of the printed sheets. The printed sheet grammages may differ from print job to print job, for example if light-weight paper sheets are processed in one print job and heavy board sheets are processed in another print job. In this case, the air supply to the fan jet nozzle configuration can be adapted to the different printed sheet grammages.

In accordance with a further mode of the invention, the operating parameters are settings of the printing press as far as perfecting or double-sided printing and straight printing or one-sided printing are concerned. In this case, the printing press is a perfecting press with a reversing device for reversing the printed sheets. The reversing device may be adjusted in a desired way, in that it reverses the printed sheets in the perfecting mode and transports the printed sheets without reversing them in the straight-printing mode. The fan jet nozzle configuration may be controlled in such a way that the air supply in the perfecting mode differs from the air supply in the straight-printing mode. As a result, the sheets are conveyed smoothly and without disruption caused by the powder sprayer even in the perfecting mode.

In accordance with an added mode of the invention, the emission speed of supportive fan jets of the fan jet configuration is modified as a function of the operating parameters. If the operating parameters are the varying printed sheet grammages, the emission speed of the supportive fan jets emitted by the fan jet nozzle configuration is modified as a function of the printed sheet grammages, that is to say when the printing press is switched from processing printed sheets of lower grammage to processing printed sheets of higher grammage, the emission speed of the supportive fan jets is increased. In the other case, i.e. if the operating parameters are the settings of the printing press in terms of perfecting or straight printing, the emission speed of the supportive fan jets of the fan jet nozzle configuration is modified as a function of the settings, that is to say when the printing press is switched from the perfecting mode to the straight-printing mode, the emission speed of the supportive fan jets is increased.

In accordance with an additional mode of the invention, the emission speed of powdered-air core jets of the fan jet nozzle configuration remains unchanged when the emission speed of the supportive fan jets is modified. The supportive fan jets may be generated by a first blown-air generator and the powdered-air core jets may be generated by a second blown-air generator.

The two developments that have been mentioned in the last two paragraphs are based on the concept that the fan jet nozzle configuration includes a plurality of fan jet nozzles and each of the fan jet nozzles includes a core jet nozzle channel and a fan jet nozzle channel surrounding the core jet nozzle channel. Each fan jet nozzle emits the powdered-air core jet from the core jet nozzle channel, which is a blown-air jet mixed with powder for powdering the printed sheets. The fan jet nozzle channel of each fan jet nozzle emits the supportive fan jet, which is a blown-air jet without powder. As viewed in the flow direction of the supportive fan jet, the latter has a substantially annular profile in the interior of which the powdered-air core jet is located. The fan jet nozzle channels of the fan jet nozzles are connected to the first blown-air generator, which supplies the fan jet nozzle channels with the blown air of relatively high pressure of the supportive fan jets. The core jet nozzle channels are connected to the second blown-air generator, which supplies the blown air of relatively low pressure of the powdered-air core jets to the core jet nozzle channels. The blown air supplied by the second blown-air generator is mixed with powder, for example through the use of an injector, in order to form the powdered-air core jets.

With the objects of the invention in view, there is concomitantly provided a printing press, for implementing the method, comprising a powder sprayer having a fan jet nozzle configuration. A control unit controls the fan jet nozzle configuration in dependence on operating parameters of the printing press.

Other features which are considered as characteristic for the invention are set forth in the appended claims.

Although the invention is illustrated and described herein as embodied in a method of controlling a powder sprayer and a printing press having a powder sprayer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
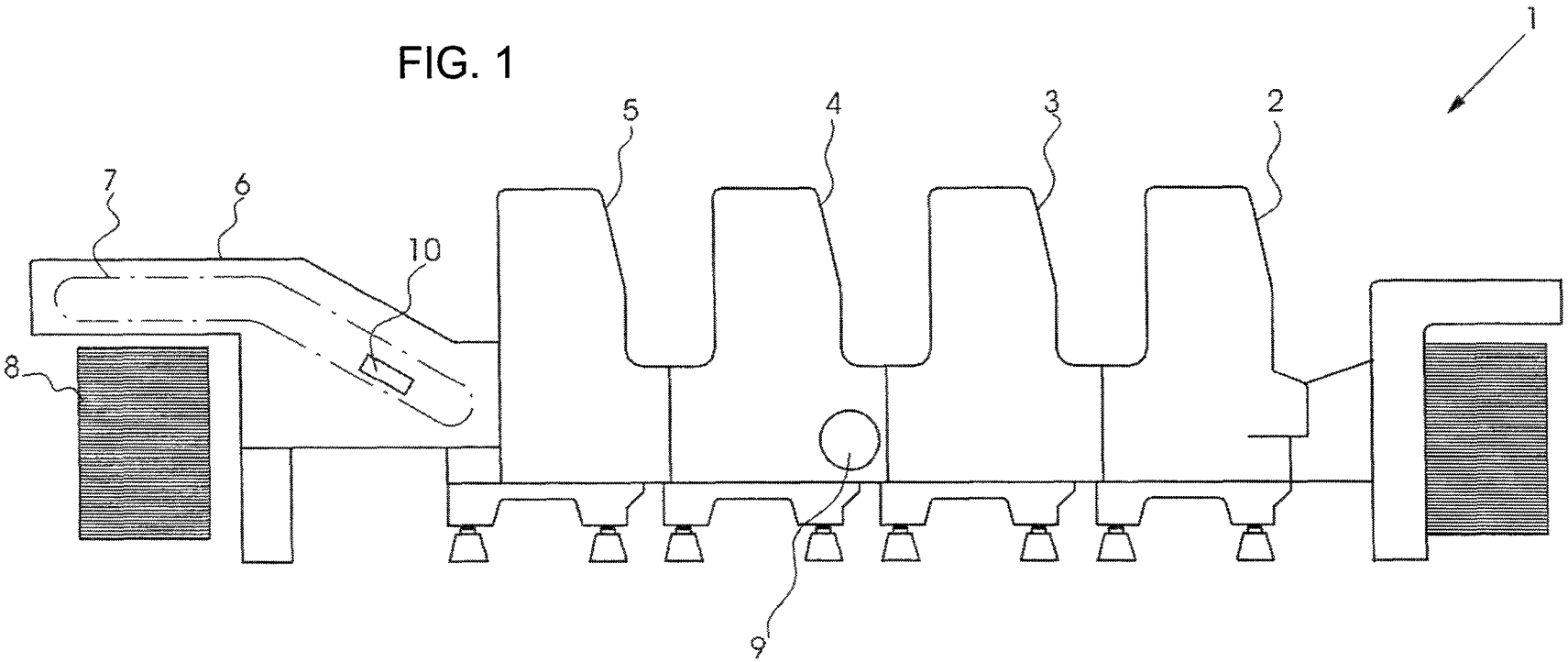
FIG. 1 is a diagrammatic, longitudinal-sectional view of a complete printing press including a sheet delivery and a powder sprayer disposed therein.

Referring now to the figures of the drawings in detail and first, particularly, to FIG. 1 thereof, there is seen a printing press 1 including printing units 2 to 5 and a sheet delivery 6. The sheet delivery includes a chain conveyor 7, which deposits printed sheets on a delivery pile 8. Moreover, the printing press 1 includes a reversing device 9, which can be switched from a straight-printing mode, in which only one side of the sheets is printed, to a perfecting mode, in which both sides of the sheets are printed. In the straight-printing mode without sheet reversal, both the printing units 2 and 3 located upstream of the reversing device and the printing units 4 and 5 located downstream of the reversing device print on the front side of the printed sheets. In the perfecting mode, the printed sheets are printed on the front side in the upstream printing units 2 and 3 and on the back side in the downstream printing units 4 and 5. The sheet delivery 6 includes a powder sprayer 10, which powders the printed sheets as they are conveyed past by the chain conveyor 7.

Figure 2:
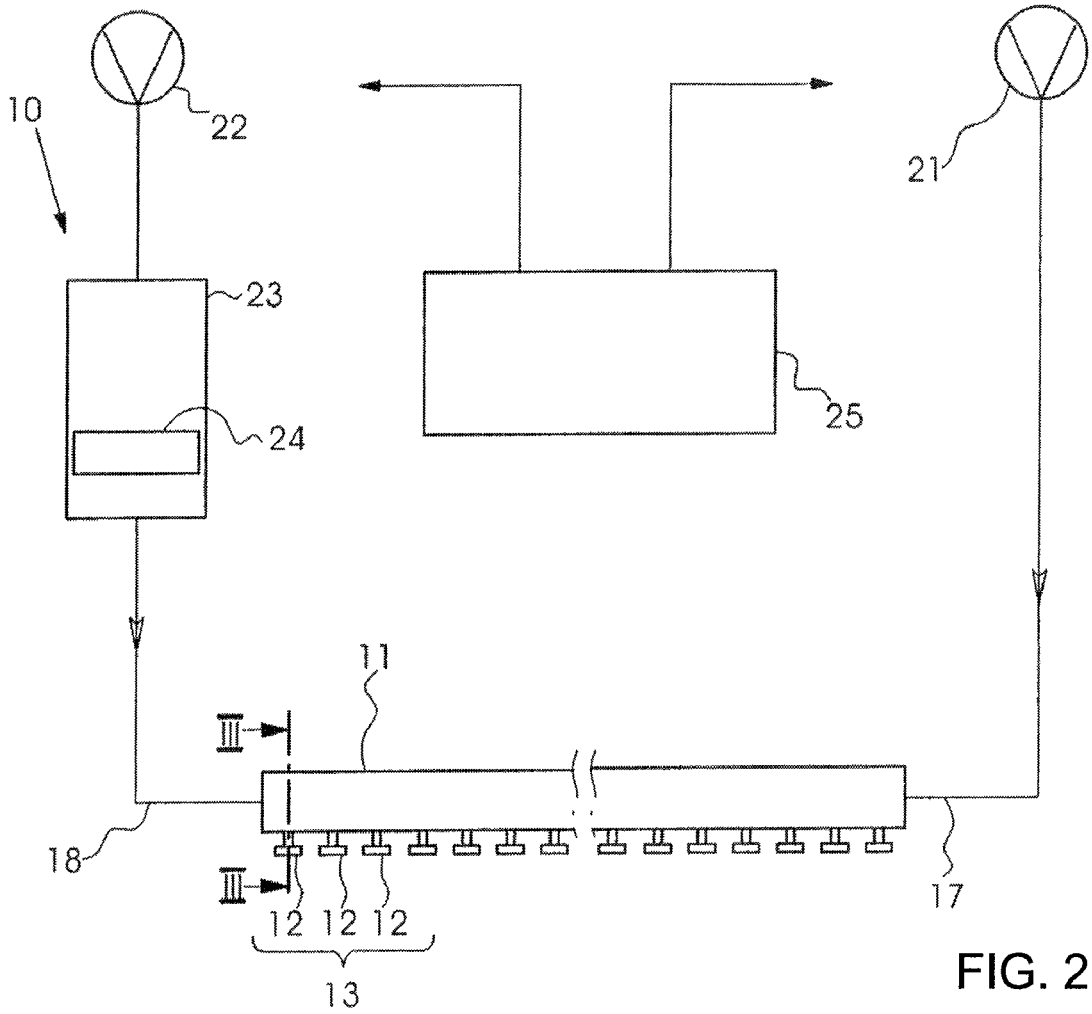
FIG. 2 is a diagrammatic and schematic view of the powder sprayer.

FIG. 2 shows that the powder sprayer includes a nozzle bar 11 that has surrounding jet nozzles or fan jet nozzles 12 disposed thereon. The fan jet nozzles 12 are disposed in a row over the width of the printed sheet. Together, they form a fan jet nozzle configuration 13. The nozzle bar 11 is connected to a first blown-air generator 21, and to a second blown-air generator 22 through a metering device 23. The metering device 23 includes an injector 24, which introduces the powder into the blown air generated by the second blown-air generator 22 to form a powder/air mixture. The blown-air generators 21, 22, which belong to the powder sprayer 10, may be disposed outside the printing press 1 and are controlled by an electronic control unit 25.

Figure 3:
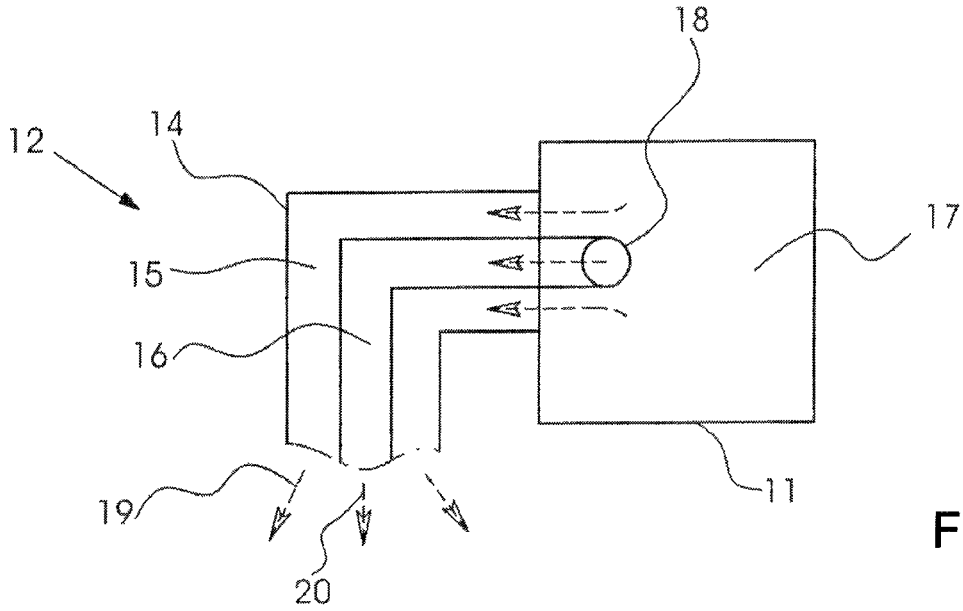
FIG. 3 is a sectional view of the powder sprayer taken along a line III-III of FIG. 2, in the direction of the arrows and representing a nozzle bar and a nozzle head disposed thereon.

FIG. 3 shows that each of the fan jet nozzles 12 is constructed in the form of a nozzle head 14 attached to the nozzle bar 11. Each fan jet nozzle 12 includes an outer fan jet nozzle channel 15, which has a substantially annular cross section, and an inner core jet nozzle channel 16, which is surrounded by the fan jet nozzle channel 15.

The outer fan jet nozzle channel 15 is connected to the first blown-air generator 21 through a supportive-air line 17. The core jet nozzle channel 16 is connected to the second blown-air generator 22 through a powdered-air line 18. The supportive-air line 17 and the powdered-air line 18 are formed of air channels formed in the nozzle bar 11 and of hose or tube lines connected to the nozzle bar 11. The outer fan jet nozzle channel 15 emits a supportive-air fan jet 19 from its opening and the core jet nozzle channel 16 emits a powdered-air core jet 20 from its opening.

In a non-illustrated modified embodiment, the fan jet nozzle configuration is formed of a row of core jet nozzle channels that is disposed between an upstream row of fan jet nozzle channels and a downstream row of fan jet nozzle channels, as viewed in the direction of sheet travel. The core jet nozzle channels emit powdered-air core jets, which are locked in between two blown-air curtains emitted by the two rows of fan jet nozzle channels, to form supportive-air fan jets.

The powder sprayer 10 operates as follows:

The second blown-air generator 22 supplies blown air at a pressure of between 0.5 bar and 1.0 bar to the powdered-air line 18. However, the effect of the second blown-air generator 22 is unavoidably reduced by the injector 24. As a result, the total of the forces, which result from the differentiation of the momentum of the powdered-air core jets 20 as a function of time, only range between 0.1 Newton and 2.0 Newton, preferably between 0.5 Newton and 1.0 Newton. The forces may be measured at the openings of the core jet nozzle channels 16, and their number corresponds to the total number of nozzle heads 14 of the nozzle bar 11. The total of the forces can be said to be the resultant force. The first blown-air generator 21 supplies blown air at a pressure of approximately 0.2 bar to the supportive-air line 17. This pressure is comparatively low, so that a central blown-air supply of the printing press 1 may be used as the first blown-air generator 21. The second blown-air generator 22 may be a compressor that is separate from the central blown-air supply. The total of the forces, which results from a differentiation of the momentum of the supportive-air fan jets 19 as a function of time, ranges between 0.5 Newton and 18.0 Newton, preferably between 2.0 Newton and 6.0 Newton. These forces may be measured at the openings of the fan jet nozzle channels 15, and the number of these forces corresponds to the total number of fan jet nozzles 12 of the nozzle bar 11, which is 24 in the given example.

The momentum of the supportive-air fan jets is not only varied in dependence on the machine speed, the format of the printed sheets, the settings of the delivery, and a powder removal by suction, but also in dependence on the grammage of the printed sheets and on whether the printing press 1 is being operated in the straight-printing mode or in the perfecting mode.

Sheets of higher grammage require a higher supportive-air momentum than sheets of lower grammage. Once the grammage of the printed sheets of the upcoming print job have been input into the electronic control unit 25, the latter automatically adjusts the output of the first blown-air generator 21 in such a way that the blown-air generator 21 generates the air pressure required for the necessary supportive-air momentum in the supportive-air line 17.

A higher supportive-air momentum is needed in the straight-printing mode than in the perfecting mode. Once the mode of operation of the printing press 1 for the upcoming print job has been input at the control unit 25, for example the straight-printing mode, the electronic control unit 25 adjusts the reversing device 9 and the first blown-air generator 21 in a corresponding way.

It is an advantage that the powdered air and the supportive air are supplied from separate sources and that it is not the momentum of both air lines that is increased but only the momentum of the supportive-air line 17. This means that the existing central blown-air supply (first blown-air generator 21) of the printing press 1 can be used to increase the momentum. The momentum of the powdered air generated by the second blown-air generator 22 may be maintained at a constant minimum value. The total momentum of the air required to stabilize the powdered-air jet is primarily generated by the outer supportive air rather than by the inner powdered air. This feature reduces cost and saves construction space. Of course, it is possible to adjust the amount of powder introduced into the printing press, which is also referred to as a characteristic powder curve, in a manner corresponding to the respective effectiveness of the powder application.

The invention claimed is:

1. A method of controlling a powder sprayer having a fan jet nozzle configuration in a printing press, the method comprising the following steps:

controlling the fan jet nozzle configuration as a function of operating parameters of the printing press;

selecting the operating parameters as settings of the printing press for perfecting or straight printing;

varying an emission speed of supportive-air fan jets of the fan jet nozzle configuration as a function of the settings; and increasing the emission speed of the supportive-air fan jets when the printing press is switched from a perfecting mode to a straight-printing mode.

2. The method according to claim 1, which further comprises varying an emission speed of supportive-air fan jets of the fan jet nozzle configuration as a function of the operating parameters.

3. The method according to claim 2, which further comprises maintaining unchanged an emission speed of powdered-air core jets of the fan jet nozzle configuration when the emission speed of the supportive-air fan jets varies.

4. The method according to claim 3, which further comprises generating the supportive-air fan jets with a first blown-air generator and generating the powdered-air core jets with a second blown-air generator.

5. The method according to claim 1, which further comprises maintaining unchanged an emission speed of powdered-air core jets of the fan jet nozzle configuration when the emission speed of the supportive-air fan jets is increased.

6. The method according to claim 5, which further comprises generating the supportive-air fan jets with a first blown-air generator and generating the powdered-air core jets with a second blown-air generator.

7. The method according to claim 1, which further comprises generating the supportive-air fan jets with a first blown-air generator and generating the powdered-air core jets with a second blown-air generator.

8. A printing press, comprising:

a powder sprayer having a fan jet nozzle configuration with supportive-air fan jets; and a control unit for controlling said fan jet nozzle configuration in dependence on operating parameters of the printing press, said control unit:

selecting the operating parameters as settings of the printing press for perfecting or straight printing;

varying an emission speed of said supportive-air fan jets as a function of said settings; and increasing said emission speed of said supportive-air fan jets when the printing press is switched from a perfecting mode to a straight-printing mode.

* * * * *